US005112388A

United States Patent [19]

Schulz et al.

[11] Patent Number: 5,112,388

[45] Date of Patent: May 12, 1992

[54] PROCESS FOR MAKING NANOCRYSTALLINE METALLIC ALLOY POWDERS BY HIGH ENERGY MECHANICAL ALLOYING

[75] Inventors: Robert Schulz, Brossard; Jean-Yves Huot, St-Hubert; Michel Trudeau, Longueuil, all of Canada

[73] Assignee: Hydro-Quebec, Montreal, Canada

[21] Appl. No.: 396,677

[22] Filed: Aug. 22, 1989

[51] Int. Cl.[5] ..... C23C 10/00; B22F 1/00

[52] U.S. Cl. ..... 75/255; 75/352; 75/354; 148/11.5 P; 148/403; 419/23; 419/33

[58] Field of Search ..... 148/11.5 P, 403; 75/352, 354, 255; 419/23, 33

[56] References Cited

U.S. PATENT DOCUMENTS

| | | | |
|---|---|---|---|
| 3,591,362 | 7/1971 | Benzamin | 75/354 |
| 4,358,475 | 11/1982 | Brown et al. | 427/34 |
| 4,443,249 | 4/1984 | Weber et al. | 75/352 |
| 4,564,396 | 1/1986 | Johnson et al. | 148/403 |
| 4,640,816 | 2/1987 | Atzmon et al. | 148/403 |
| 4,710,236 | 12/1987 | Schultz | 148/11.5 P |
| 4,735,789 | 4/1988 | Franzen et al. | 148/403 |
| 4,787,561 | 11/1988 | Kemp, Jr. et al. | 75/354 |
| 4,799,955 | 1/1989 | McClellan | 75/352 |
| 4,891,059 | 1/1990 | Diamond et al. | 75/352 |

OTHER PUBLICATIONS

Fecht et al. Met. Trans. 21A (Dec. 1990) 2333.

Atzmon Phys. Rev. Letts, 64 (Jan. 1990) 487.

Int. J. Hydrogen Energy, vol. 7, No. 5, pp. 405–410, 1987, D. E. Brown et al.

Electrochimica Acta, vol. 29, No. 11, pp. 1551–1556, 1984, D. E. Brown et al.

Appl. Phys. Lett. 49(3), Jul. 21, 1986, pp. 146–148, Richardo B. Schwartz et al.

E. Hellstern et al., Symposium, Boston, Mass. on Nov. 30–Dec. 1, 1988.

A. W. Weeber et al. Physica B., vol. 153, pp. 93–135, 1988.

*Primary Examiner*—Upendra Roy

*Attorney, Agent, or Firm*—Oblon, Spivak, McClelland, Maier & Neustadt

[57] ABSTRACT

There are described metallic powders comprising agglomerated nanocrystals of an electroactive alloy. The main component of the alloy can be of nickel, cobalt, iron or mixtures thereof while the alloying element is one or more transition metals such as Mo, W, V. Preferably the nanocrystals will be made of an alloy of nickel and molybdenum. An electrode which is used by compacting the powders is also disclosed. Also disclosed, is a process for producing the metallic powders by providing particles of nickel, cobalt and iron with particles of at least one transition metal, (Mo, W, V) and subjecting the particles to high energy mechanical alloying such as ball milling under conditions and for a sufficient period of time to produce a nanocrystalline alloy. Electrodes produced from these powders have an electrocatalytic activity for the hydrogen evolution which is comparable or higher than the electrodes which are presently used in the electrochemical industry. Moreover, these materials present an excellent chemical, electrochemical and mechanical stability.

8 Claims, 10 Drawing Sheets

PROCESS FOR MAKING NANOCRYSTALLINE METALLIC ALLOY POWDERS BY HIGH ENERGY MECHANICAL ALLOYING

BACKGROUND OF INVENTION a) Field of Invention

This invention relates to metallic powders suitable for manufacturing electrodes adapted for producing hydrogen by water electrolysis. More particularly, the invention is concerned with the manufacture of nanocrystalline (FCC) powders of alloys of nickel and molybdenum by high energy mechanical deformation, said powders having a high electrocatalytic activity for hydrogen evolution.

b) Description of Prior Art

It is known that a successful electrolysis of alkaline water can be achieved using an electrode consisting of an alloy of an element selected from the group consisting of nickel, cobalt, iron and one from Mo, W, V. Such an electrode is normally made of an alloy of nickel and molybdenum, wherein nickel is used in predominant amount.

U.S. Pat. No. 4,358,475 issued on Nov. 9, 1982 to the British Petroleum Company Limited discloses a complicated method of producing metal electrodes by coating a substrate with a homogeneous solution of compounds of iron, cobalt or nickel and compounds of molybdenum, tungsten or vanadium. The coated substrate is thereafter thermally decomposed to give an oxide-coated substrate which is then cured in a reducing atmosphere at elevated temperature. This method produces good electrodes but is obviously complicated, expensive to achieve and time consuming. The same technology is also disclosed in the following publications:

Int. J. Hydrogen Energy, Vol.7, No. 5, pp. 405–410, 1987, D. E. Brown et al.

Electrochimica Acta, Vol. 29, No. 11, pp. 1551–1556, 1984, D. E. Brown et al.

On the other hand, alloys of nickel and titanium and of nickel and niobium in the form of amorphous powders have been produced by mechanical alloying in a laboratory ball/mill mixer, as disclosed in:

Appl. Phys. Lett. 49(3), 21 July 1986, pp. 146–148, Ricardo B. Schwarz et al.

E. Hellstern et al., at a Symposium on "Multicomponent Ultrafine Microstructures" held in Boston, Mass. on Nov. 30, 1988, discloses the preparation of nanocrystalline AlRu by ball milling. The process is essentially restricted to Ru and AlRu and there is no disclosure of the usefulness of the product obtained thereby.

Finally, A. W. Weeber et al. review the production of amorphous alloys by ball milling in: Physica B, Vol. 153, pp. 93–135, 1988, A. W. Weeber and H. Bakker.

The prior art is therefore completely devoided of any disclosure of electrodes of alloys which can be used to produce hydrogen, and which have been manufactured by mechanical alloying.

It is an object of the present invention to provide metallic powders which can be used with advantage to produce electrodes that may be utilized in the electrolytic production of hydrogen.

It is another object of the present invention to provide metallic powders having a unique morphology and microstructure, which differ from those produced by other techniques and which can be used with advantage to manufacture hydrogen producing electrodes.

It is another object of the present invention to manufacture low cost cathodes which can be used to produce hydrogen by means of a simple technique of fabrication without requiring chemical, thermic or electrochemical treatment of the active materials.

It is another object of the present invention to provide a material for the manufacture of electrodes which requires no substrates.

SUMMARY OF INVENTION

The present invention relates to metallic powders comprising agglomerated nanocrystals of a main alloy of at least one metal selected from the group consisting of nickel, cobalt, iron and at least one transition metal from Mo, W or V.

The invention also relates to a process for manufacturing metallic powders suitable for preparing electrodes having electrocatalytic properties for the production of hydrogen. The process uses particles of at least one metal selected from the group consisting of nickel, cobalt or iron and of at least one transition metal from Mo, W or V and subjecting the particles to high energy mechanical alloying under conditions and for a sufficient period of time to produce nanocrystals.

DESCRIPTION OF PREFERRED EMBODIMENTS

The term nanocrystals means a crystal whose dimension is of the order of about 1 to 50 nanometers.

The preferred combination for the agglomerated nanocrystals are nickel and molybdenum.

Although the amounts of the various components forming the main alloy can vary to a large extent, in view of the higher cost of molybdenum compared to nickel, it has been found preferable to provide a main alloy which comprises at least about 40 At. % nickel, the balance comprising molybdenum. For example, a main alloy which comprises from about 60 At. to about 85 At.% of nickel has shown to give excellent results. A typical alloy is one containing 60 At. % nickel and 40 At. % molybdenum and another is one containing 85 At. % nickel and 15 At. % molybdenum. These two concentrations of nickel, have been tested and have given impressive results as will be shown later, indicating that this technique can be successfully applied on a relatively wide concentration range.

The powders obtained are pressed while cold or at moderate temperatures to prevent recrystallisation and segregation. It will therefore be realised that the metallic powders according to the invention can be sold as such to be later transformed into an electrode. Previously, the electrode had to be prepared in final form. In the present case, it is merely necessary to obtain the powders, and to press it on any kind of support such as a grid or a plate to constitute an electrode.

Finally, the surface of the pressed metal powder forming an electrode could be post treated, such as by oxidation-reduction to give even better results as it is well known to those skilled in the art.

As mentioned above, according to the invention, the process involves high energy mechanical alloying to produce metallic powders of an alloy such as nickel/-molybdenum, whose microstruture in this case is that of an agglomerate of face centered cubic nanocrystals, i.e. crystals whose dimension is of the order of about 1 to 50 nanometers.

The expression high energy used in the present invention in association with the term "mechanical alloying", is intended to means that the mechanical alloying is sufficient to cause a rupture of the crystals of the alloy as well as allowing sufficient interdiffusion between the elementary components.

In practice, the mechanical alloying according to the invention is carried out by ball milling although any other techniques such as grinding of the particles or cold rolling of thin elementary foils could also be used.

In practice, ball milling should be carried out in a crucible and with balls which do not contaminate too much the final product. In this case, ball milling is carried out in a crucible of a carbide of a transition metal, with balls made of the same material. A preferred material is tungsten carbide because of its hardness and because this material is readily available. Molybdenum carbide could also be used.

Although the proportions of the particles of nickel and molybdenum can vary to a large extent, they should be selected to achieve an alloy whose content of nickel and molybdenum is as mentioned above, such as containing at least about 40 At. % nickel, preferably, from about 60 to 85 At. % nickel and about 15 to 40 At. % molybdenum. Good results have been obtained, as indicated above with a main alloy comprising 60 At. % nickel and 40 At. % molybdenum and another alloy comprising 85 At. % nickel and 15 At. % molybdenum.

Typically the speed of the balls is greater than about 1 meter per second. Good results have been obtained when the operation is carried out for a period of time of at least 15 hours under these conditions.

When the operation in the ball mill lasts for a long period of time (more than typically 25 hours), we find, in addition to the FCC nanocrystals of nickel-molybdenum, minor amounts of Tungsten carbide, an impurity phase coming from the crucible. The presence of this impurity phase, however, does not seem to affect the electrocatalytic performance of the alloy as shown in FIG. 1.

After obtaining metallic powders of agglomerated nano crystals of an alloy of nickel and molybdenum, the powders could be pressed at a moderate temperature to prevent recrystallisation or phase segregation, in the form of an electrode or on a support, such as a grid or a plate to constitute an electrode.

It is believed that the production of nanocrystals in the metallic powders according to the invention produce a large number of active sights, which are responsible for the high electrocatalytic activity of the electrode produced.

Molybdenum is responsible for the dilatation of the Ni crystals. In other words, high energy mechanical alloying such as ball milling forces molybdenum inside the crystals of nickel where it remains in spite of the phase diagram At the start of the high energy mechanical alloying, the particles come in contact with one another and are bound together. After a few hours of mechanical alloying, during which the amount of deformation of the nickel and the molybdenum crystallites increases, there is a diffusion of the atoms of molybdenum inside the crystals of nickel, the latter being fragmented into units which are increasingly smaller. After about twenty hours of deformation, the structure of the metallic powders consists of an agglomerate of FCC crystals of nickel saturated with molybdenum whose dimension is lower than or on the other of 50 nanometers. As mentioned above, these nanocrystals can be mixed with a small amount of an impurity phase coming from the tungsten carbide balls of the walls of the crucible.

Electrodes manufactured from these powders have presented, during tests made for the electrolysis of water at 70° C. in KOH 30 wt% an electroactivity which is comparable or higher than that of electrodes presently used in the electrochemical industry.

The overpotential measured at 250 mA $cm^{-2}$ is of 60 mV and at 500 mA $cm^{-2}$ it is about 90 mV.

These overpotentials are stable during the first 15 hours. These performances are preserved after many interruptions or removals from the cell.

BRIEF DESCRIPTION OF THE DRAWINGS

The invention will now be illustrated by means of the following drawings in which.

DESCRIPTION OF THE PREFERRED EMBODIMENTS

Figure 1:
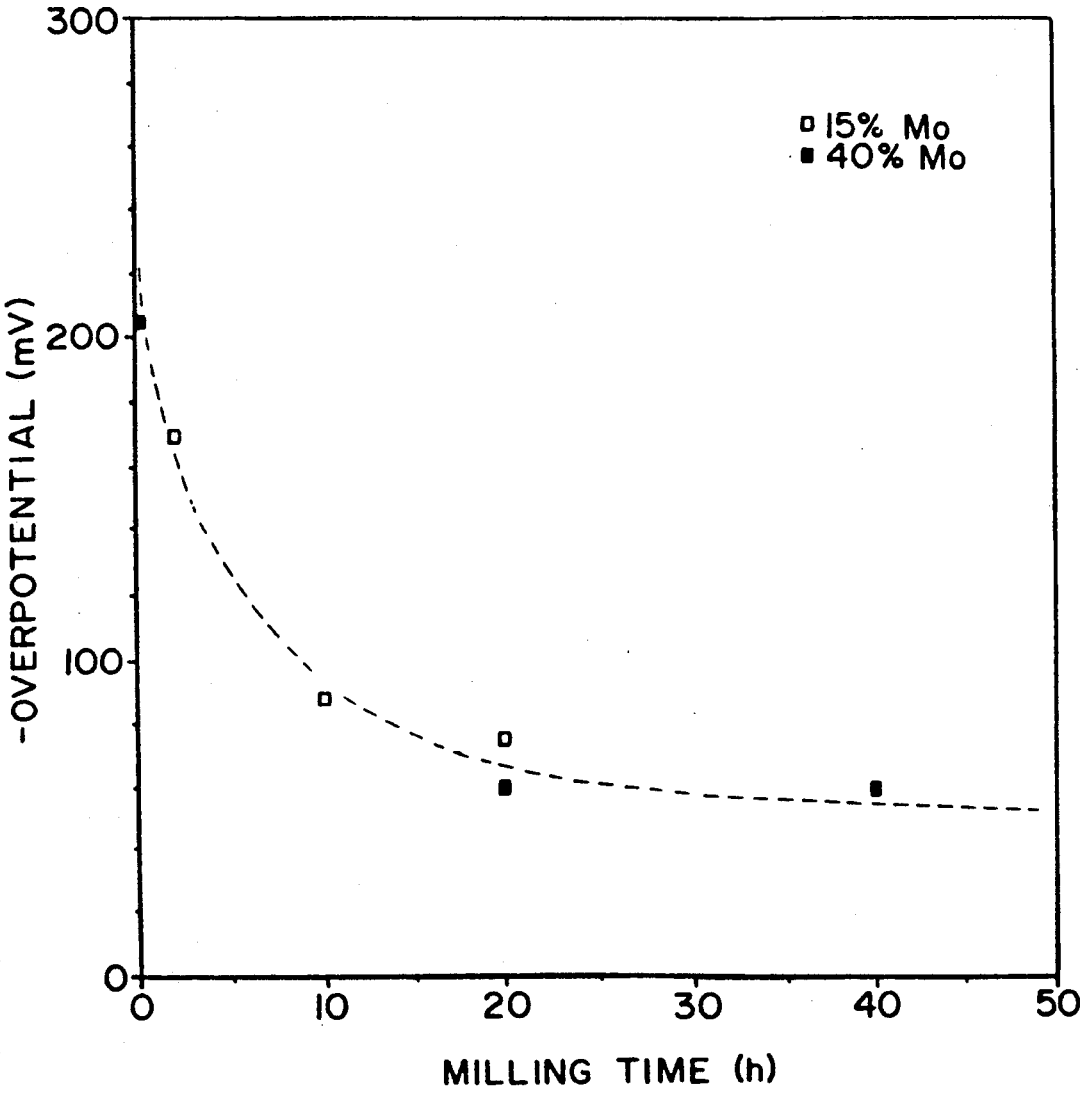
FIG. 1 is a curve representing the overpotential with respect to milling time of the alloys according to the invention containing respectively 15 At. % and 40 At. % molybdenum.

Referring to FIG. 1, it will be seen that both the alloys containing 15 At. % molybdenum and 40 At. % molybdenum, have an acceptable overpotential already after about 10 hours of milling time. However, a real good overpotential is obtained after 20 hours and it will be noted that the potential slightly improves as the milling time is extended past 15 hours.

Figure 2:
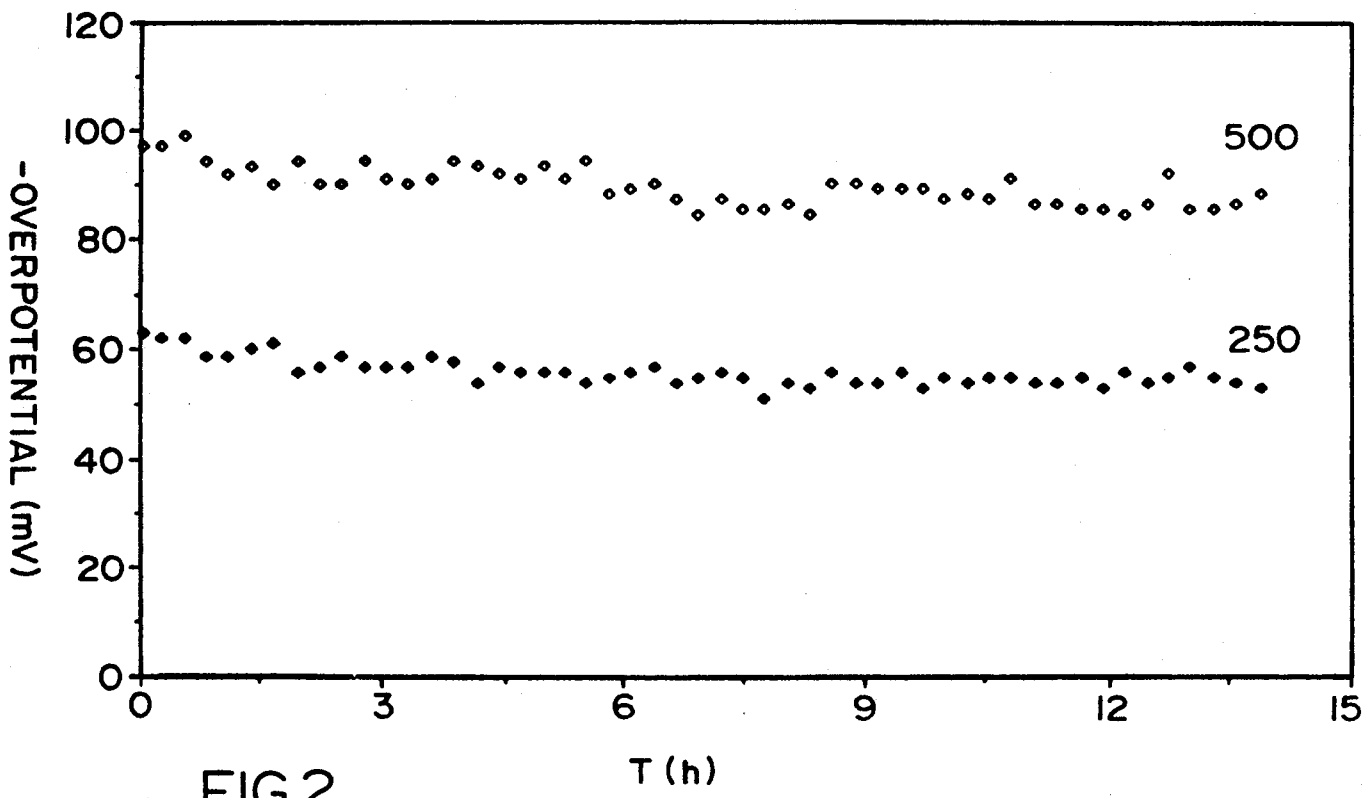
FIG. 2 shows the time dependance of the overpotential of $Ni_{60}Mo_{40}$ alloy according to the invention respectively at 500 and 250 mA $cm^{-2}$.

Referring to FIG. 2, it will be noted that an alloy having 40 At. % molybdenum shows a good overpotential, i.e. lower than 100 mV even after 15 hours of testing at 500 mA $cm^{-2}$.

Another indication of the good behavior of an alloy according to the invention, is given by measuring the Tafel slope, which is a measure of the increase of potential which should be applied to the electrode to obtain an increase of current by a factor of 10. Table 1 shows that the alloys display Tafel slopes lower than 70 mV after 20 and 40 hours of milling time. The calculated overpotentials at 250 mA $cm^{-2}$ ($\eta_{250}$) confirm the high electrocatalytic activity of the alloys.

TABLE 1

Tafel parameters[1] for the hydrogen evolution reaction in 30 wt % KOH. 70° C. on Ni—Mo alloys produced by intensive ball-milling

| alloy | milling time (h) | Tafel slope (mV) | $I_o$ (mA $cm^{-2}$) | $\eta_{250}$ |
|---|---|---|---|---|
| $Ni_{60}Mo_{40}$ | 0.25 | 166 | 14.8 | 204 |
| $Ni_{85}Mo_{15}$ | 2.0 | 156 | 22 | 165 |
| $Ni_{85}Mo_{15}$ | 10.0 | 73 | 15 | 89 |
| $Ni_{85}Mo_{15}$ | 20.0 | 63 | 16 | 75 |
| $Ni_{60}Mo_{40}$ | 20.0 | 50 | 17 | 58 |
| $Ni_{60}Mo_{40}$ | 40.0 | 63 | 29 | 59 |
| $Ni_{60}Mo_{40}$ | arc melted | 107 | 0.042 | 404 |

[1]Obtained by a galvanodynamic method for a sweep rate of 1 mA $cm^{-2}$ $s^{-1}$ from 250 to 10 mA $cm^{-2}$ after keeping the electrode at 250 mA $cm^{-2}$ for 1800s.

Figure 3:
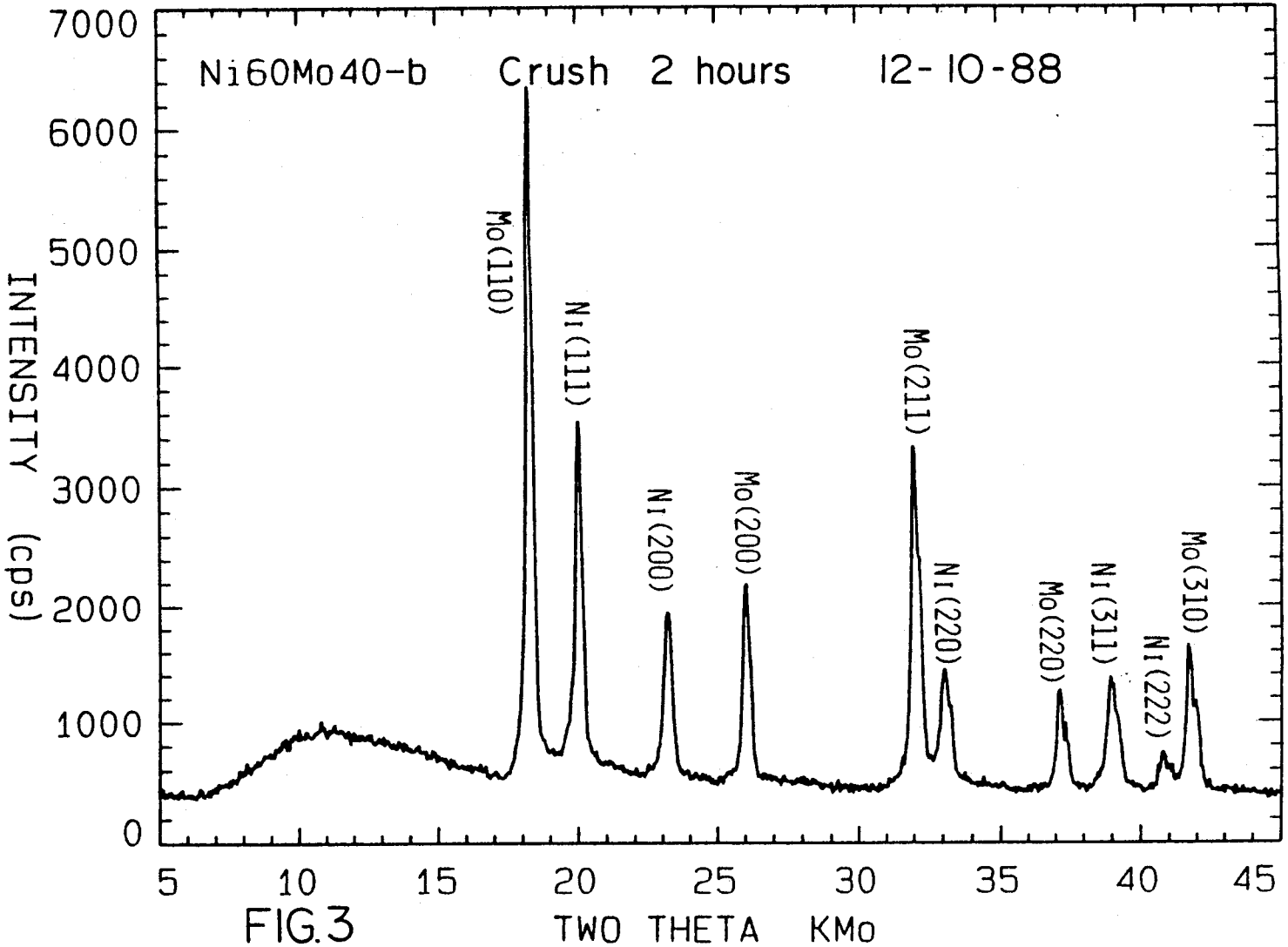
FIG. 3 is a curve representing the structure of the alloy containing 60 At. % nickel after two hours of ball milling.

Referring to FIG. 3, the structure of the mixture is shown after 2 hours of ball milling. It will be seen that the molybdenum phase is clearly separated from the nickel phase.

Figure 4:
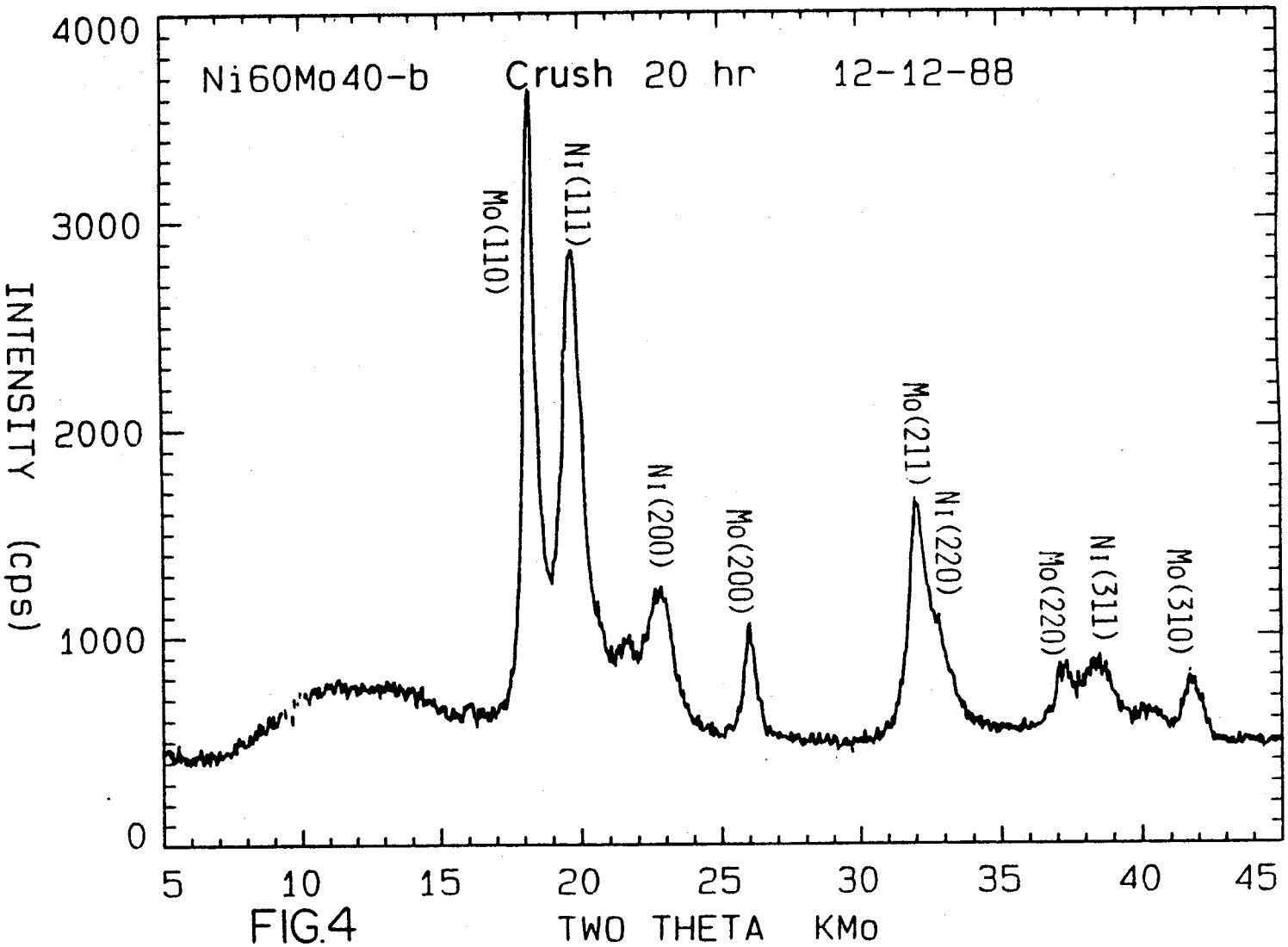
FIG. 4 is a curve similar to FIG. 3 after 20 hours of ball milling.

With respect to FIG. 4, it will be seen that the Mo peaks decrease in intensity with respect to the corresponding peaks of FIG. 3 indicating that molybdenum diffuses in the nickel, the widening of the peaks means that there is a reduction in the sizes of the crystallites.

Figure 5:
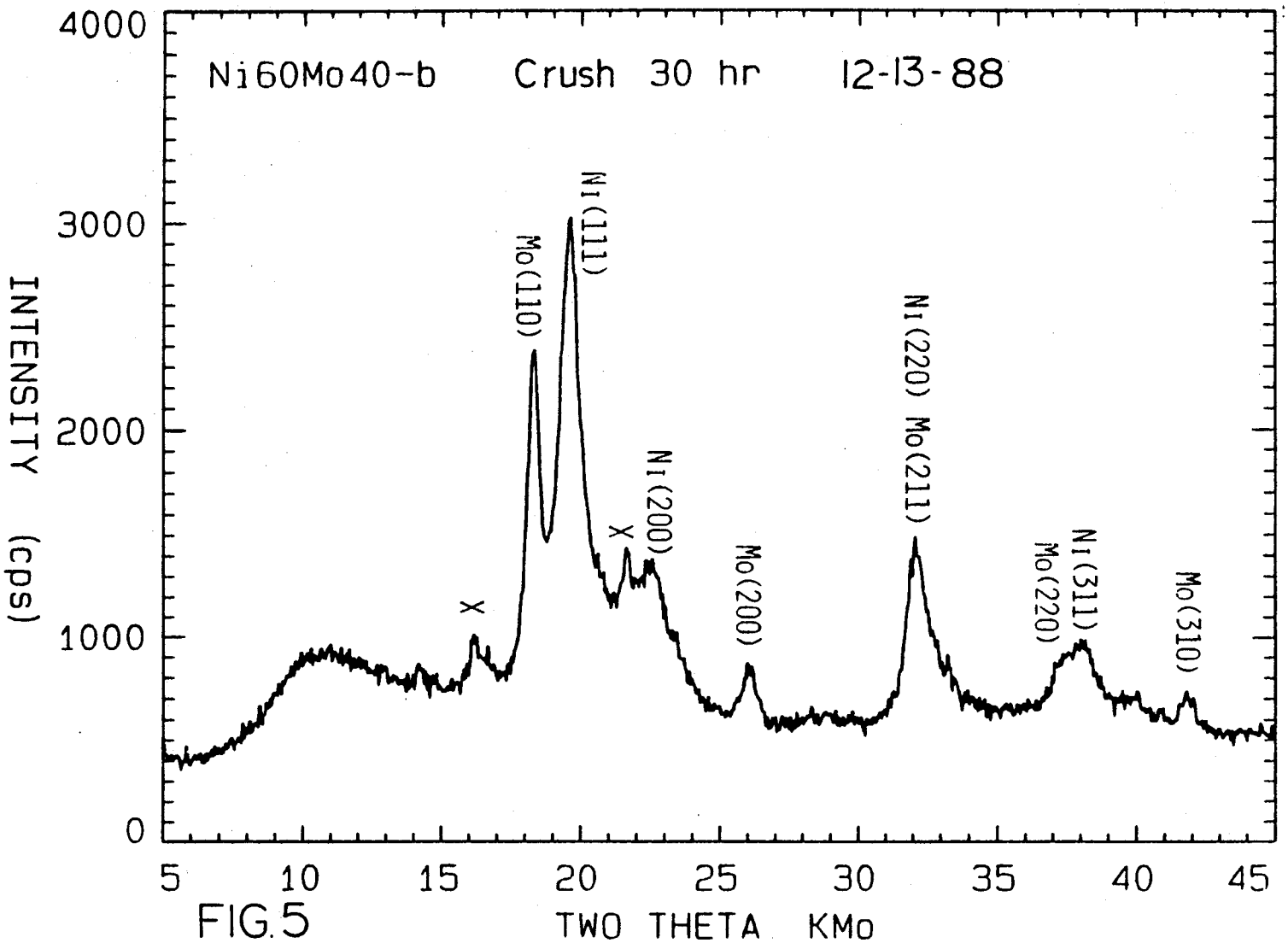
FIG. 5 is a curve similar to that of FIG. 3 after 30 hours of ball milling.

With respect to FIG. 5, it will be seen that the molybdenum peaks still decrease. This means that there is further diffusion of molybdenum in nickel which is also indicated by the fact that the peak (111) of nickel is displaced towards the left. One can also notice the start of the appearance of a secondary impurity phase, denoted by X, and identified as being Tungsten carbide.

Figure 6:
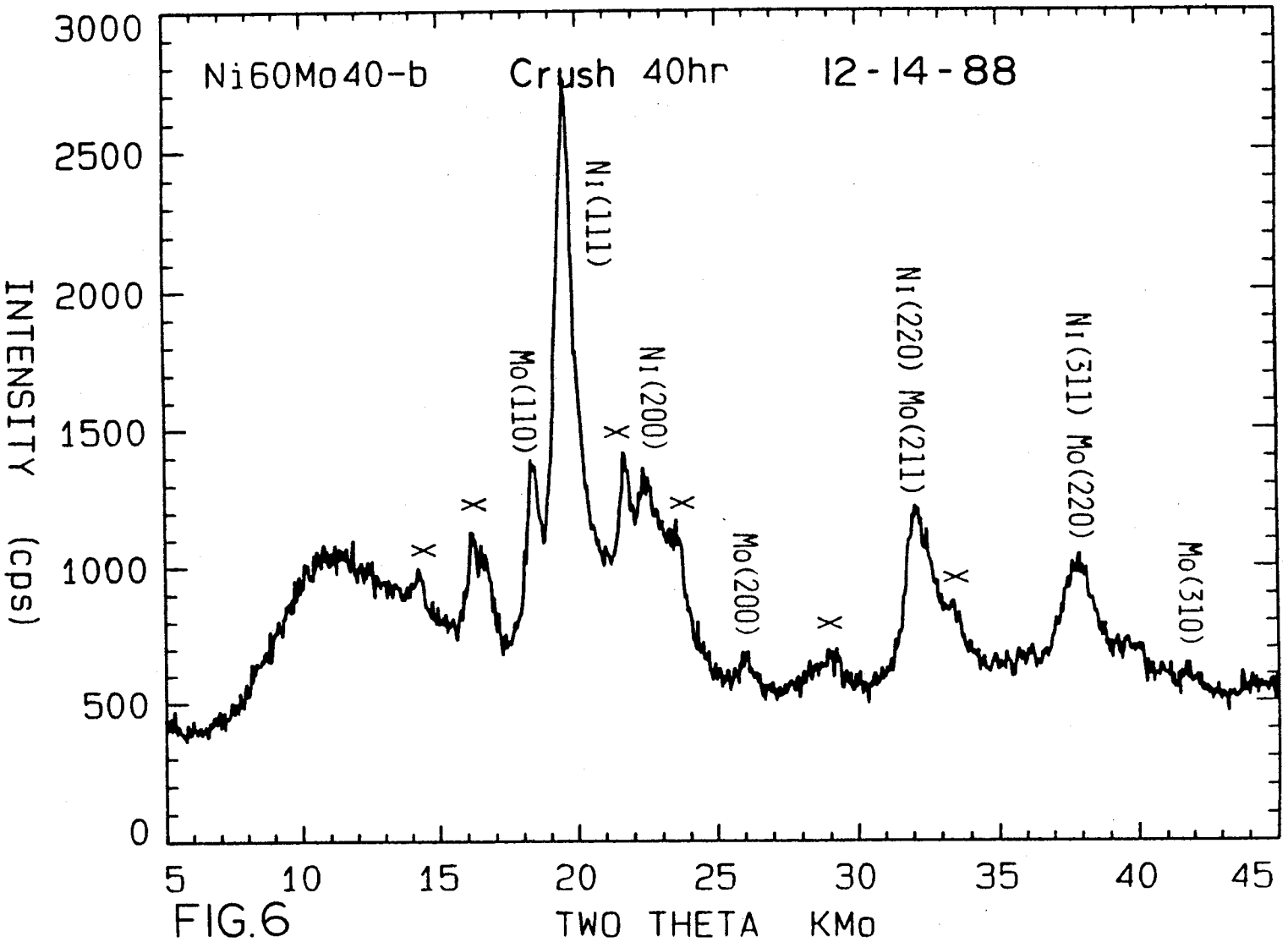
FIG. 6 is a curve similar to FIG. 3 after 40 hours of ball milling.

With reference to FIG. 6, there is an increase in the amount of secondary phase after 40 hours of milling time.

Figure 7:
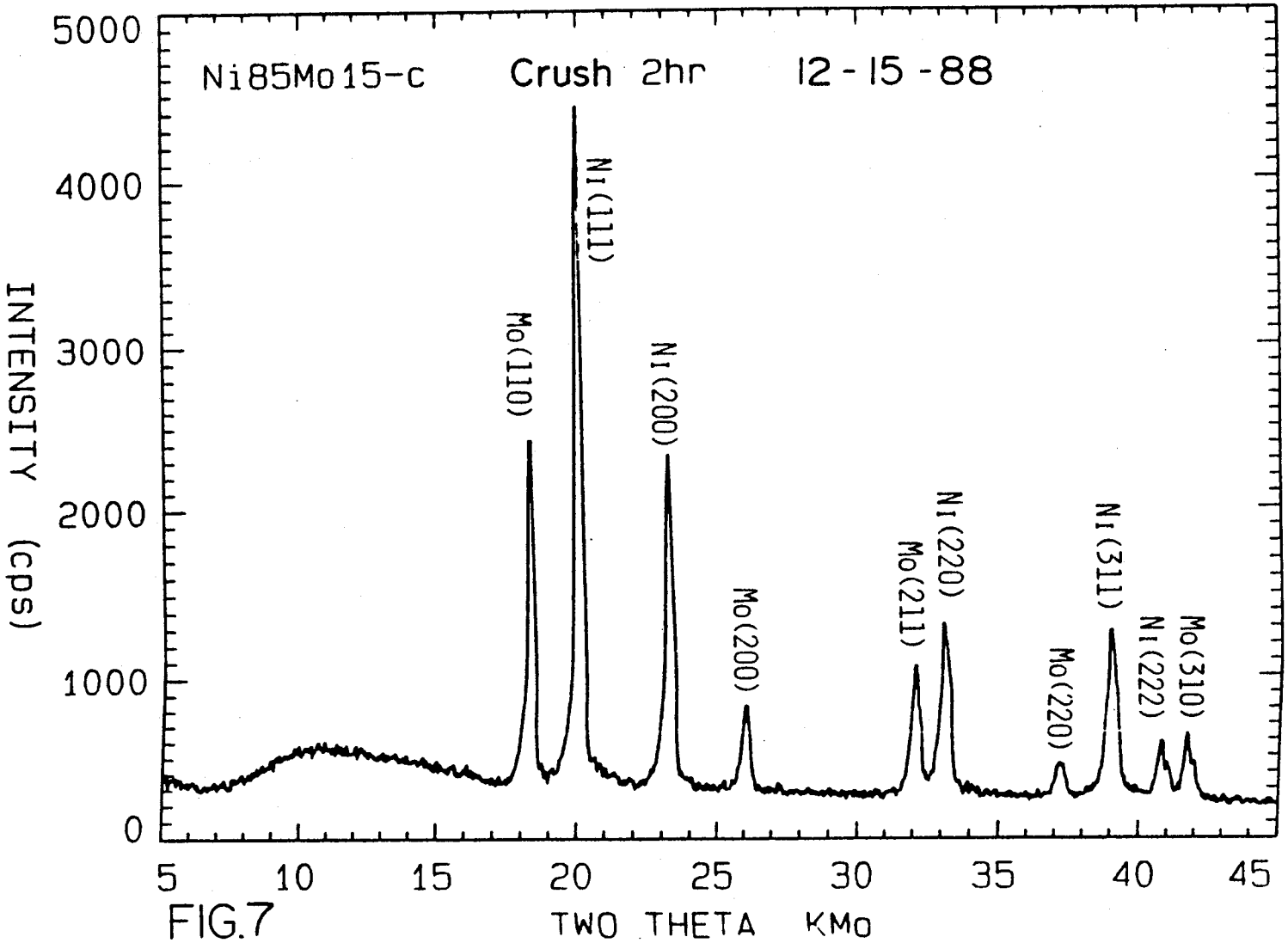
FIG. 7 is a curve similar to FIG. 3 for an alloy containing 85 At. % nickel and 15 At. % molybdenum.
Figure 8:
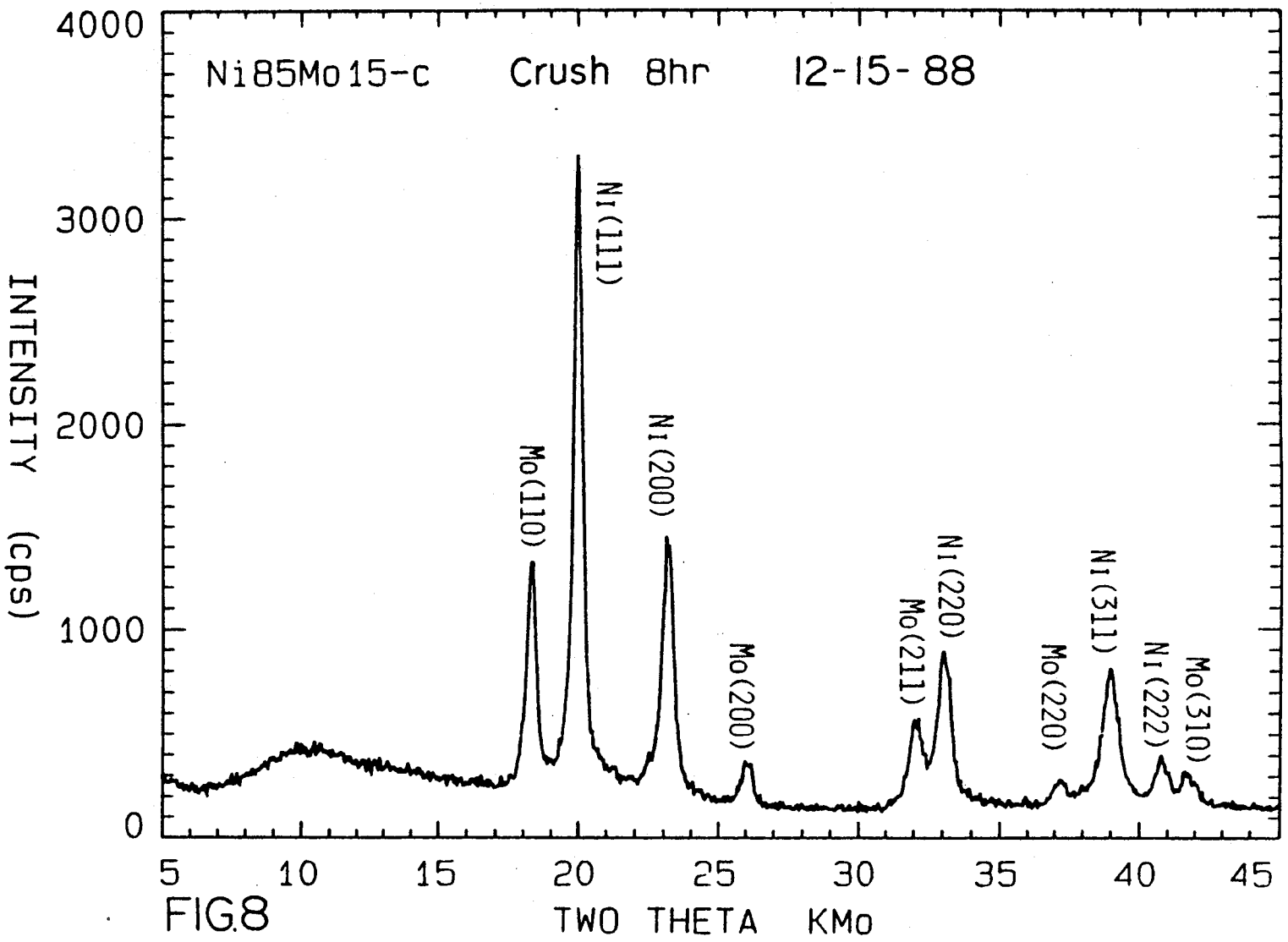
FIG. 8 is a curve similar to that of FIG. 7 after 8 hours of deformation.
Figure 9:
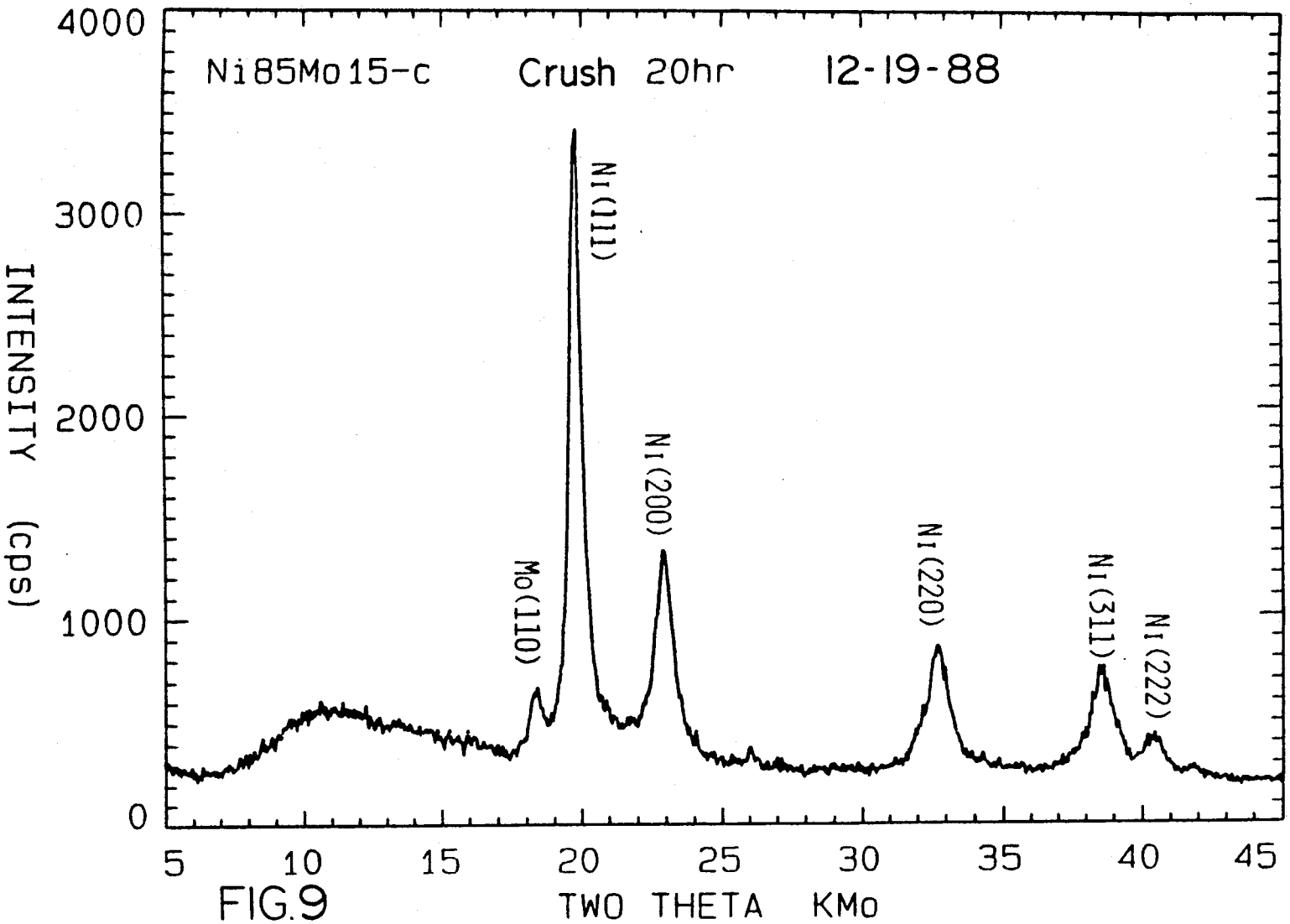
FIG. 9 is a curve similar to that of FIG. 7 after 20 hours of deformation.

FIGS. 7, 8 and 9 correspond to those which were given before for the alloy containing 60 At. % nickel but this time we are dealing with an alloy containing 85% nickel. The same results can be observed.

Figure 10:
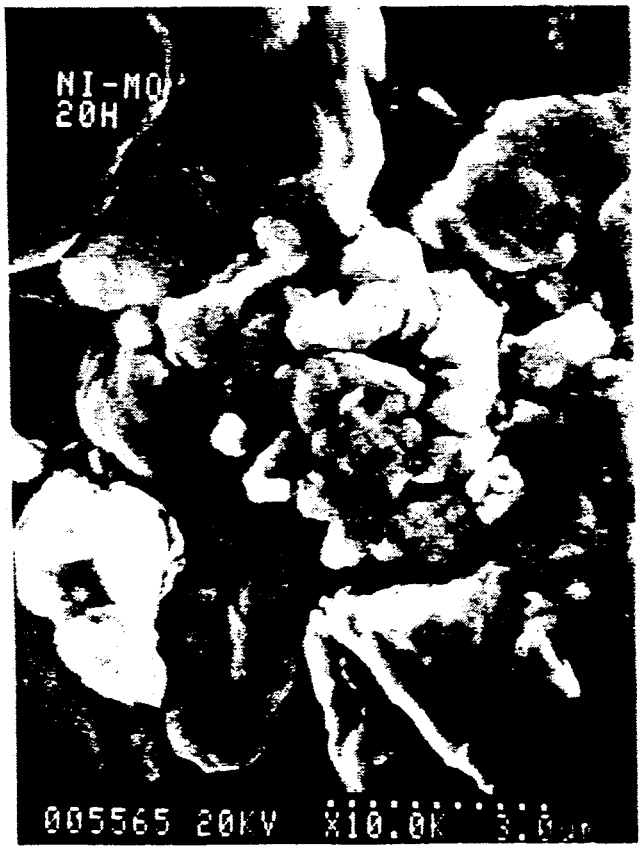
FIG. 10 shows the morphology of an alloy according to the invention containing 85 At. % nickel and 15 At. % molybdenum after 20 hours of ball milling.

The morphology shown in FIG. 10 shows that the surface of a consolidated powder electrode according to the invention is quite smooth on a microscopic scale. A treatment to roughen the surface in order to render the electrode even more active could be applied.

The embodiments of the invention in which an exclusive property or privilege is claimed, are defined as follows:

1. A process for producing metallic powders suitable for preparing electrodes having electrocatalytic properties enabling said electrodes to give hydrogen by water electrolysis, said process comprising providing particles of nickel and particles of molybdenum in a proportion to produce nanocrystals of a main alloy of nickel and molybdenum comprising at least about 40 At. % nickel, the balance being molybdenum; and subjecting said particles to high energy mechanical alloying under conditions and for a sufficient period of time to produce said nanocrystals of said main alloy.

2. The process according to claim 1, wherein said main alloy comprises from about 60 to about 85 At. % nickel and about 15 to 40 At. % molybdenum.

3. The process according to claim 1, wherein said main alloy comprises about 60 At. % nickel and 40 At. % molybdenum.

4. The process according to claim 1, wherein said main alloy comprises about 85 At. % nickel and 15 At. % molybdenum.

5. The process according to claim 1, wherein said metal powders comprise agglomerated nanocrystals of an alloy of nickel and molybdenum and are pressed at a temperature of prevent recrystallization and segregation of phases in said alloy, to constitute an electrode.

6. The process according to claim 5, wherein said metallic powders are pressed on a support comprising a grid.

7. The process according to claim 5, wherein said metallic powders are pressed on a support comprising a plate.

8. The process according to claim 1, wherein said high energy mechanical alloying comprises ball milling particles of nickel and particles of molybdenum while adjusting the speed of said ball to greater than about 1 meter/second.

* * * * *